United States Patent [19]

Lauwasser

[11] 3,956,653

[45] May 11, 1976

[54] ROTATING ANODE X-RAY TUBE

[75] Inventor: Albert B. Lauwasser, Skokie, Ill.

[73] Assignee: Litton Industrial Products, Inc., Beverly Hills, Calif.

[22] Filed: Feb. 3, 1975

[21] Appl. No.: 546,388

[52] U.S. Cl. ..... 313/60; 313/149
[51] Int. Cl.[2] ..... H01J 35/10
[58] Field of Search ..... 313/60

[56] References Cited

UNITED STATES PATENTS 3,634,870 1/1972 Kessler ..... 313/60

*Primary Examiner*—R. V. Rolinec
*Assistant Examiner*—Darwin R. Hostetter
*Attorney, Agent, or Firm*—Robert M. Vargo

[57] ABSTRACT

An X-ray tube is disclosed having a cathode and rotating anode located within a glass envelope. The rotating anode comprises an annular disc forming the target area. The disc is integrally connected to a stem which in turn is connected to a hollow cylindrical rotor. The interior of the cylindrical rotor extends over the anode support shaft and bearing structure. The anode shaft supports the rotor, stem and anode disc and is integrally connected thereto via a thin-walled, cup-shaped member made of a low heat conductive metal. The interfaced connections with the cup-shaped element are accomplished through minimal contact surfaces to provide a thermal barrier against the heat energy generated in the anode structure, thereby preventing the heat energy from passing through to the shaft and bearing structure.

4 Claims, 2 Drawing Figures

ROTATING ANODE X-RAY TUBE

BACKGROUND OF THE INVENTION

1. Field of the Invention

The present invention relates generally to x-ray tubes and more specifically to x-ray tubes having rotating anodes.

2. Description of the Prior Art

Production of an x-ray beam by electron bombardment of a target dates back to the early 1900's. The early x-ray tube consisted of a gas-filled glass envelope containing a cathode and an anode (target). By imposing a high voltage charge between cathode and anode, a glow discharge took place, causing electron bombardment of the target and production of x-ray energy.

Later improvements consisted of evacuating the atmosphere around the cathode and anode elements, and the use of a hot tungsten filament within the cathode, permitting the focusing of the electron beam. It was then possible to generate an x-ray beam from a more closely controlled bombardment source, thereby yielding greater diagnostic detail.

Finally, a rotating target structure was developed in the early 1940's which permitted a further shrinking of the electron bombardment area, opening up even greater possibilities for improved diagnostic techniques.

Current diagnostic x-ray tubes contain rotating anodes on which targets, which weigh as much as one kilogram, rotate at speeds up to 10,000 rpm. Because of a number of factors, such as thermal expansion and contraction, and high acceleration and deceleration torques, these structures tend to yield short life due to bearing and unbalance problems.

SUMMARY OF THE INVENTION

The present invention obviates the above-mentioned shortcomings by providing a rotating anode x-ray tube having excellent anode balance stability and bearing life.

In its broadest aspect, the present invention relates to an x-ray tube having an anode disc mounted on a stem which in turn is connected to a rotor. The entire anode structure is supported by a shaft and bearing structure rotatively mounted on a base. The shaft is interconnected to the anode structure by an element forming a thermal barrier therebetween to prevent heat energy generated in the anode structure from passing through to the shaft and bearing structure.

An advantage of the present invention is that the low bearing temperature created by the structure of the present invention enables a relatively softer steel to be utilized for the bearing structure, thereby enabling it to be lubricated more effectively with a soft metallic powder and to run at a lower noise level.

Another advantage of the present invention is that the thermal barrier structure allows the x-ray tube to maintain a low shaft operating temperature thereby enabling the bearings to retain their physical properties, mechanical stability and soft metal lubricant.

The anode support shaft also forms the inner raceway for the bearings by providing appropriate ball filling slots. The advantage of this structure is that the shaft can be of a relatively large diameter for stability.

The features of the present invention, which are believed to be novel, are set forth with particularity in the appended claims. The present invention, both as to its organization and manner of operation, together with the further advantages thereof, may best be understood by reference to the following description taken in connection with the accompanying drawings.

DETAILED DESCRIPTION OF THE PREFERRED EMBODIMENT

Figure 1:
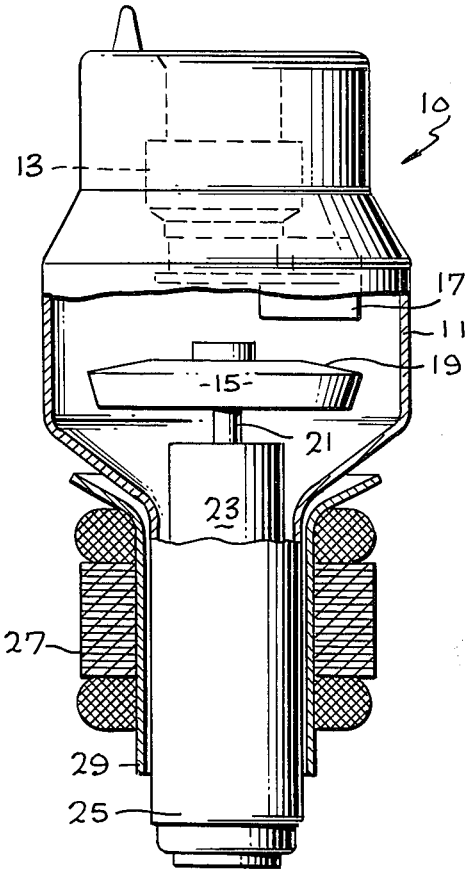
FIG. 1 is an elevational view of a rotating anode x-ray tube with a portion of the glass enclosure broken away to illustrate the rotating anode structure.

Referring now to the drawings, FIG. 1 shows an x-ray tube generally indicated by arrow 10, having a glass envelope 11 enclosing a cathode 13 and a rotating anode 15. A tungsten filament 17 is positioned adjacent the cathode 13. The anode 15 is in the form of a disc having a target area 19. The anode disc 15 is connected through a stem 21 to a hollow cylindrical rotor 23 rotatively mounted within the lower portion 25 of the glass envelope 11. A stator 27 is fixedly mounted about the exterior of the lower portion 25 of the envelope 11. The stator structure 27 is mounted on a cylindrical support structure 29 utilized for supportingly receiving the glass envelope 11.

Figure 2:
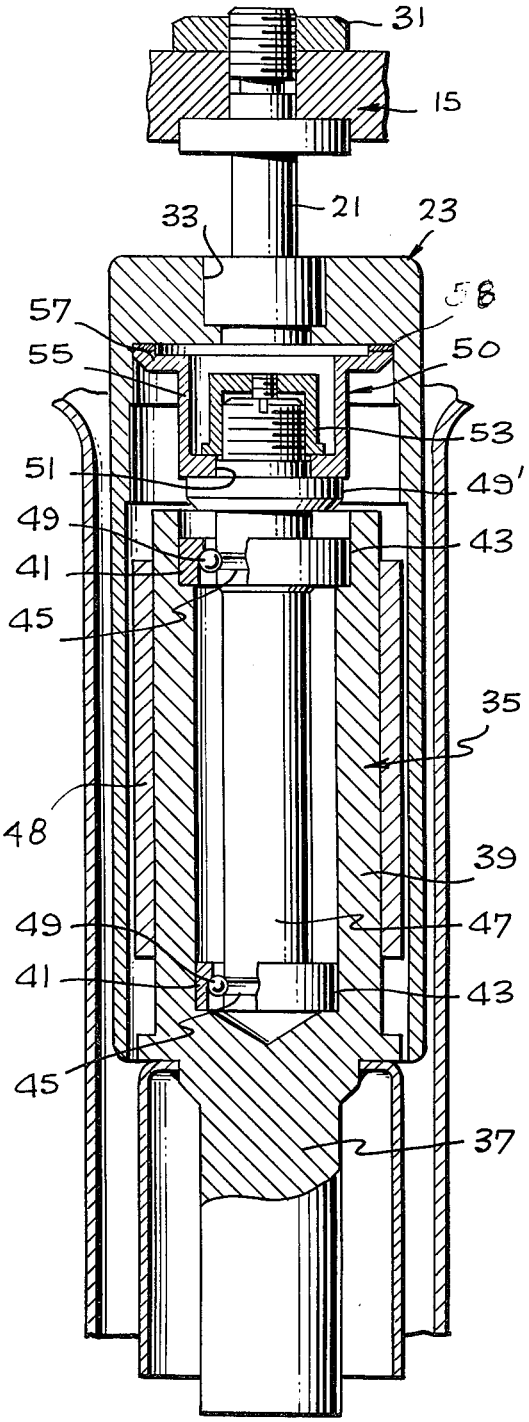
FIG. 2 is an enlarged sectional view of the anode shaft and bearing structure in accordance with the present invention.

Referring now to FIG. 2, the anode disc 15 is fixedly connected to the stem 21 by a nut 31. The lower portion of the stem 21 extends into an aperture 33 formed in the rotor 23 and is integrally connected thereto by any conventional means. The interior of the rotor 23 extends over the bearing and support structure generally indicated by arrow 35. The support structure 35 comprises an elongated base member 37 having an upper cylindrical copper structure 39 for supportingly receiving a pair of outer bearing races 41 of bearings 43. The inner races 45 are created by grooves formed on an anode support shaft 47. A plurality of roller ball bearings 49 are then located within the bearing races 41 and 45. A steel cylinder 48 extends about the cylindrical structure 39 to enhance the motor torque characteristics. The upper end of the anode support shaft 47 includes an annular member 49' forming a shoulder for supporting a cup-shaped member 50. The bottom portion of the cup-shaped member 50 includes an aperture 51 for receiving the threaded end of the support shaft 47. A nut 53 is utilized to threadedly connect the cup-shaped member 50 to the support shaft 47. The cup-shaped member 50 further includes a thin cylindrical wall 55 extending upwardly and terminating in a disc-shaped support structure 57. The support structure 57 is integrally connected via a 42% nickle steel washer 58 to the interior upper end of the rotor 23. As can be seen, the cup-shaped member 50 forms the interconnection and support between the rotating anode structure and the shaft 47.

Appropriate electrical connectors are provided to permit tube and motor energization.

OPERATION

In operation, the stator 27 is activated electrically causing the anode 15 (and target) to rotate. The tungsten filament 17 is lit to an electron emissive temperature, and a high voltage is impressed between the anode 15 and cathode 17. This causes an electron beam to traverse the anode-cathode space, striking the rotating target 19 and generating x-ray energy.

In a typical rotating anode x-ray tube, the target temperatures generated may be as high as 1300°C. Approximately 80% of the heat dissipated from the target is radiated, and the remaining 20% convects through the stem 21 and into the anode structure. A large portion of the heat energy travels from the anode structure down through the support shaft 47 thereby heating the shaft 47 and the bearings 43.

However, in accordance with the present invention, the cup-shaped member 50 is located between the rotor 23 and the support shaft 47 to form a thermal barrier to prevent heat energy from reaching the shaft 47 and bearings 41. The first thermal barrier is formed at the junction of the interior upper end of the rotor 23 and the disc-shaped support structure 57. The thin wall 55 of the cup-shaped member 50 also provides a minimal path for the heat energy passing therethrough. The thickness of the wall is preferably 2/100 of an inch. A second thermal barrier is provided between the junction of the lower portion of the cup-shaped member 50 and the annular member 49. Moreover, the cup-shaped member 50 is made of a metal having a low heat conductivity such as 42% nickel steel.

As can be seen with such a structure, because of the minimal contact surface at the junctions, the thin tubular dimensions of the wall 55 and the use of a low heat conductive steel, most of the heat energy is conducted through the rotor 23 with only a minute portion of the heat energy passing through the cup-shaped member 50 onto the bearing structure 41. As a result, bearing temperature is held to a low level consistent with good bearing and lubrication life.

It should also be noted that the shaft 47 forms the inner races 45 of the bearing structure 41 thereby eliminating the need for an inner race. As a result, the bearing shaft 47 can be made of a relatively larger diameter thereby increasing its stability.

It should be noted that various modifications can be made to the assembly while still remaining within the purview of the following claims.

What is claimed is:

1. An x-ray tube comprising:

a cathode;

a rotating anode mounted on a stem, said stem being integrally connected to a hollow cylindrical rotor;

a support shaft mounted within the interior of said rotor, said shaft being rotatively supported through ball bearings by a base element, said support shaft being interconnected to said rotor and anode structure by means forming a thermal barrier between the anode structure and the support shaft, wherein said thermal barrier means comprises a separate element made of low thermal conductive metal, said separate element being a cup-shaped member having an upper and lower surface respectively interfaced with the said rotor and said support shaft; and said support shaft forming the inner races for said ball bearings to enable the shaft to have a substantially constant cross-section throughout its entire length.

2. The combination of claim 1 wherein said upper and lower surfaces are separated by a thin wall.

3. The combination of claim 2 wherein the thickness of said thin wall is 2/100 of an inch.

4. The combination of claim 3 wherein said cup-shaped member is made of 42% nickel steel.

* * * * *